US006966070B2

(12) United States Patent
Gillen et al.

(10) Patent No.: US 6,966,070 B2
(45) **Date of Patent: *Nov. 22, 2005**

(54) PROTECTIVE BODY VEST

(76) Inventors: James B. Gillen, 444 W. Witchwood, Lake Bluff, IL (US) 60044; Sherry S. Gillen, 444 W. Witchwood, Lake Bluff, IL (US) 60044

( * ) Notice: Subject to any disclaimer, the term of this patent is extended or adjusted under 35 U.S.C. 154(b) by 18 days.

This patent is subject to a terminal disclaimer.

(21) Appl. No.: 10/671,858

(22) Filed: Sep. 26, 2003

(65) Prior Publication Data

US 2004/0199983 A1 Oct. 14, 2004

Related U.S. Application Data

(63) Continuation-in-part of application No. 10/118,676, filed on Apr. 9, 2002, now Pat. No. 6,738,984, which is a continuation-in-part of application No. 10/000,246, filed on Oct. 29, 2001, now Pat. No. 6,446,273.

(51) Int. Cl.[7] ..... A41D 1/04
(52) U.S. Cl. ..... 2/102
(58) Field of Search ..... 2/102, 94, 455, 2/456, 459, 463, 2.5, 247, 69, 108

(56) References Cited

U.S. PATENT DOCUMENTS 2,756,429 A 7/1956 Malachowski
4,668,202 A 5/1987 Scheurer et al.
4,697,285 A 10/1987 Sylvester
D340,542 S 10/1993 Marlowe
5,328,398 A 7/1994 Aubrey
5,465,424 A 11/1995 Cudney et al.
5,669,080 A 9/1997 Culton
6,138,277 A 10/2000 Gillen et al.
6,446,273 B1 9/2002 Gillen et al.
6,738,984 B2 * 5/2004 Gillen et al. ..... 2/2.5

* cited by examiner

*Primary Examiner*—Tejash Patel
(74) *Attorney, Agent, or Firm*—Meroni & Meroni, P.C.; Christopher J. Scott; Charles F. Meroni, Jr.

(57) ABSTRACT

This invention concerns a protective body vest/vest/jersey for protecting against impact upon a human torso when worn by an athlete during sporting activities. The invention comprises a multi-layered, one-piece garment comprising a vest/jersey sized and shaped to be worn on the torso of an athlete with a protective padding that can be customized by the wearer based on safety, comfort and athletic performance concerns. The invention further comprises a pair of shoulder portions with a fastening means therein for attaching or accommodating the attaching of a shoulder pad type object, an anterior portion, a pair of lateral portions and a posterior portion. The invention further either utilizes an offset opening or offset openings located off set from the medial line of a human torso to protect the heart, or is donned/removed in an over-the-head, pullover manner. The invention may further utilize an overlap or flap to cover and protect the region of the offset opening.

34 Claims, 2 Drawing Sheets

PROTECTIVE BODY VEST

PRIOR HISTORY

This is a Continuation-in-Part Application of U.S. patent application Ser. No. 10/118,676, filed Apr. 9, 2002 now U.S. Pat. No. 6,738,984, which application is a Continuation-in-Part Application of U.S. patent application Ser. No. 10/000,246 filed Oct. 29, 2001, now U.S. Pat. No. 6,446,273.

BACKGROUND OF THE INVENTION

1. Field of the Invention

The present invention relates to protective body vests/jerseys for protecting against impact upon a human torso when worn by an athlete during sporting activities. More specifically, the present invention is primarily intended to provide a baseball/softball player added protection from injuries resulting from being hit by a pitched, thrown, hit or tipped ball, being tagged with a ball or colliding with another player. The present invention can also be utilized by athletes engaged in other sporting activities, such as, but not limited to, inline skating, skateboarding, water sports, and touch football, to provide added protection from injuries resulting from falling and/or colliding with another person, player, or matter.

2. Description of the Prior Art

In recent years, many vests have been created for the purpose of providing protection to the torso of an athlete engaged in sporting activities. These vests, however, only afforded protection to limited areas of the body. In particular, U.S. Pat. No. 5,669,080, issued to Culton, discloses a protective apparatus against baseball pitching injuries, which is essentially a partial vest contoured to protect the chest, shoulders, and upper arms of the athlete. Designed primarily for use by baseball/softball umpires, the Protective Apparatus is not conducive to batting, running, throwing, fielding or sliding motions due to the combination of adjustable flexible and non-flexible arm and shoulder straps which secure the apparatus snugly to the arms, shoulders and neck of the wearer, prohibiting the full and easy movement of the arms and neck of an athlete wearing the apparatus, and the protective covering over the upper arms which the apparatus provides. In addition, the degree of protection afforded by the Protective Apparatus from a pitched, hit, thrown or tipped ball, a fall, or a collision is limited since 1) there is no protection for the lateral regions and the back of the torso and 2) the amount of protective material in the apparatus is limited since it is designed to fit under the shirt of an umpire. Designed primarily for use by baseball/softball umpires who would wear the apparatus for an extended period of time (i.e., the duration of a baseball/softball game), the Protective Apparatus is not quickly and easily donned due to the number, location and operation (i.e., any required adjustment for fit) of the securing straps and the fact that the wearer has to put on the vest over his/her head while placing one arm at a time through the arm straps. In particular, to achieve the proper fit of the shoulder strap, the wearer would have to reach around his/her lower back with both hands for the most effective operation of the adjusting mechanism, which is located behind the wearer, unless he/she solicited the help of another person.

Moreover, U.S. Pat. No. 4,668,202, issued to Scheurer et al., and U.S. Pat. No. 5,328,398, issued to Aubrey, both disclose protective vests for flotation utilized in water sporting activities. These vests both have a reduced overall flexibility for other sporting activities due to the relative rigidity of the vest materials. Further, both of these water vests utilize an exposed center opening for the user to put on the vest, a deep V-neck design and a plurality of securing belts fastened across the center opening. These water vests are primarily designed for flotation purposes and not for protection against impact from sporting activities. As such, these vests do not provide the necessary protection needed for the whole torso. Though the water vests provide some protection against the impact of the water, the combination of the center opening and deep V-neck design exposes the heart of the athlete to impact. Further, the body area below the center opening is unprotected, as the center opening is not covered by protective material. Additionally, the securing belts fastened across the center opening are uncovered, resulting in a possible "catch." Finally, the back of these water vests does not protect the lower spine area of the body from impact forces. In particular, U.S. Pat. No. 4,668,202 contains a rear opening to adjust the vest to the particular body size that leaves the back exposed to impact forces.

It is therefore highly advantageous to provide a protective vest/jersey that can provide protection from a multi-section, one-piece garment to the torso. In addition, it is advantageous to provide a protective vest/jersey that allows for the removal and insertion of protective padding relative to the wearer's safety, comfort and athletic performance concerns. Further, it is advantageous to provide a protective vest/jersey wherein each shoulder portion comprises at least one fastening device or means therein for attaching or accommodating the attaching of a shoulder pad type object. Further yet, it is advantageous to provide a protective vest/jersey that comprises sleeves that incorporate protective padding. The present invention provides these and other advantages as is hereinafter explained.

SUMMARY OF THE INVENTION

According to our present invention we have provided a multi-section, one-piece garment for protecting against impact upon a human torso when worn by an athlete during sporting activities comprising a vest/jersey sized and shaped to be worn on the torso of an athlete having a multi-layered padding to protect the torso of the athlete. The vest/jersey, which is donned and removed in an over-the-head, pullover manner, is comprised generally of a shoulder portion, an anterior portion, a pair of lateral portions and a posterior portion. The multi-layered padding has a first, or outer layer, a second, or middle layer and a third, or inner layer, wherein the first and the third layers sandwich, or are joined at a seam to provide a shell for, the second layer, the second layer being formed from a padding material for protecting the torso against impact.

Each shoulder portion comprises at least one fastening device or means therein for attaching or accommodating the attaching of a shoulder pad type object.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, the anterior portion and sized and shaped to provide protection from impact to the anterior portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, the posterior portion and sized and shaped to provide protection from impact to the posterior portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, at least one lateral portion and sized and shaped to provide protection from impact to the lateral portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, at least one shoulder portion and sized and shaped to provide protection from impact to the shoulder portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

Each shoulder portion may have a sleeve attached which may or may not be removable. Each sleeve may have the lower portion of the sleeve being removable. Each sleeve may incorporate protective padding to provide protection to at least one portion of the arm socket/shoulder joint area, the upper arm area, the middle arm or elbow area and/or the lower arm area that may or may not be removable.

In another embodiment, we have provided a multi-section, one-piece garment that is donned and removed in an over-the-head, pullover manner, for protecting against impact upon a human torso when worn by an athlete during sporting activities comprising a vest/jersey sized and shaped to be worn on a torso of an athlete including an anterior portion, a posterior portion, a pair of lateral portions and a shoulder portion, the vest/jersey having a multi-layered padding in the anterior portion and/or the shoulder portion and/or the lateral portions and/or the posterior portion of the vest/jersey, the shoulder portion and/or the lateral portions and/or the posterior portion of the vest/jersey being comprised primarily, if not totally of material that allows for the cooling of the underlying torso. The multi-layered padding has a first, or outer layer, a second, or middle layer and a third, or inner layer wherein the first layer and the third layer sandwich, or are joined at a seam to provide a shell for, the second layer, the second layer being formed from a padding material.

Each shoulder portion comprises at least one fastening device or means therein for attaching or accommodating the attaching of a shoulder pad type object.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, the anterior portion and sized and shaped to provide protection from impact to the anterior portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, the posterior portion and sized and shaped to provide protection from impact to the posterior portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, at least one lateral portion and sized and shaped to provide protection from impact to the lateral portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, at least one shoulder portion and sized and shaped to provide protection from impact to the shoulder portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

Each shoulder portion may have a sleeve attached which may or may not be removable. Each sleeve may have the lower portion of the sleeve being removable. Each sleeve may incorporate protective padding to provide protection to at least one portion of the arm socket/shoulder joint area, the upper arm area, the middle arm or elbow area and/or the lower arm area that may or may not be removable.

In another embodiment of the vest/jersey, we have provided a multi-section, one-piece garment for protecting against impact upon a human torso when worn by an athlete during sporting activities comprising a vest/jersey sized and shaped to be worn on a torso of an athlete including an anterior portion, a posterior portion, a pair of lateral portions, a shoulder portion and an offset opening or offset openings, the vest/jersey having a multi-layered padding in the anterior portion and the shoulder portion and/or the lateral portions and/or the posterior portion of the vest/jersey, the posterior portion and/or the lateral portions and/or the shoulder portion of the vest/jersey being comprised primarily, if not totally of material that allows for the cooling of the underlying torso. The multi-layered padding has a first, or outer layer, a second, or middle layer and a third, or inner layer wherein the first layer and the third layer sandwich, or are joined at a seam to provide a shell for, the second layer, the second layer being formed from a padding material. The offset opening or offset openings is/are off set from the medial line of a human torso to protect the heart against impact. The present invention further comprises a fastening device or devices to engage the vest/jersey when fastened to secure the vest/jersey about the torso.

Each shoulder portion comprises at least one fastening device or means therein for attaching or accommodating the attaching of a shoulder pad type object.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, the anterior portion and sized and shaped to provide protection from impact to the anterior portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, the posterior portion and sized and shaped to provide protection from impact to the posterior portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, at least one lateral portion and sized and shaped to provide protection from impact to the lateral portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, at least one shoulder portion and sized and shaped to provide protection from impact to the shoulder portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

Each shoulder portion may have a sleeve attached which may or may not be removable. Each sleeve may have the lower portion of the sleeve being removable. Each sleeve may incorporate protective padding to provide protection to at least one portion of the arm socket/shoulder joint area, the upper arm area, the middle arm or elbow area and/or the lower arm area that may or may not be removable.

In another embodiment of the vest/jersey, we have provided a multi-section, one-piece garment for protecting against impact upon a human torso when worn by an athlete during sporting activities comprising a vest/jersey sized and shaped to be worn on the torso of an athlete having a multi-layered padding to protect the torso of the athlete. The vest/jersey is comprised generally of a shoulder portion, an anterior portion, a pair of lateral portions, a posterior portion and an offset opening or offset openings. The multi-layered padding has a first, or outer layer, a second, or middle layer and a third, or inner layer, wherein the first and the third layers sandwich, or are joined at a seam to provide a shell for, the second layer, the second layer being formed from a padding material for protecting the torso against impact. The offset opening or offset openings is/are off set from the medial line of a human torso to protect the heart against impact. The present invention further comprises a fastening device or devices to engage the vest/jersey when fastened to secure the vest/jersey about the torso.

Each shoulder portion comprises at least one fastening device or means therein for attaching or accommodating the attaching of a shoulder pad type object.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, the anterior portion and sized and shaped to provide protection from impact to the anterior portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, the posterior portion and sized and shaped to provide protection from impact to the posterior portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, at least one lateral portion and sized and shaped to provide protection from impact to the lateral portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

At least one protective pad can be attached via at least one fastening device to, or inserted into at least one pocket which may be partitioned and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, at least one shoulder portion and sized and shaped to provide protection from impact to the shoulder portion, or a section or sections thereof, the protective pad being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

Each shoulder portion may have a sleeve attached which may or may not be removable. Each sleeve may have the lower portion of the sleeve being removable. Each sleeve may incorporate protective padding to provide protection to at least one portion of the arm socket/shoulder joint area, the upper arm area, the middle arm or elbow area and/or the lower arm area that may or may not be removable.

DESCRIPTION OF THE DRAWINGS

Other features of my invention will become more evident from a consideration of the detailed description of my patent drawings, as follows.

DETAILED DESCRIPTION

Figure 1:
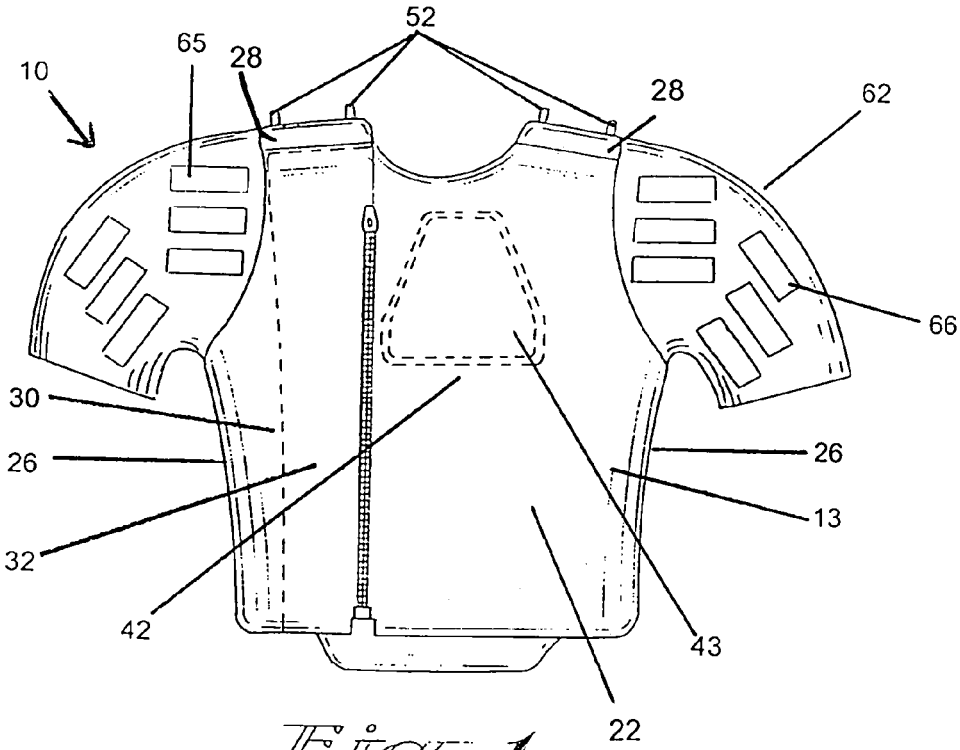
FIG. 1 is a front view of the preferred embodiment of the vest that has an offset opening with an overlap, a pocket with a removable/insertable protective pad to protect the chest area, short sleeves with protective padding to protect the arm socket/shoulder joint and upper arm areas and belt-loop-type loops in the shoulder areas belt-loop-type loops in the shoulder areas for attaching or accommodating the attaching of a shoulder pad type object.
Figure 4:
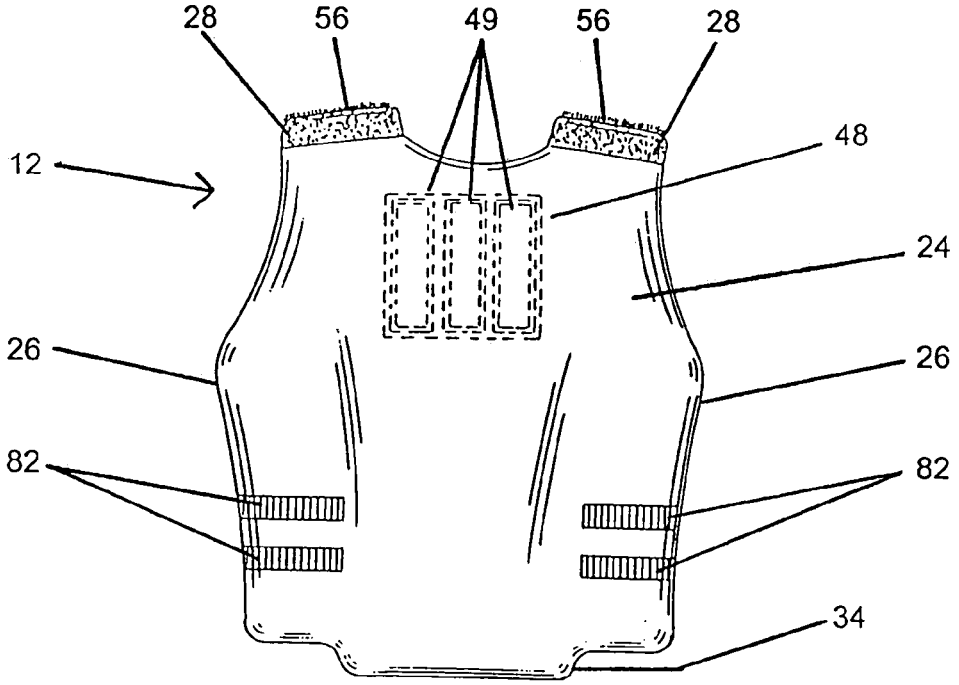
FIG. 4 is a back view of each of the embodiments of the vest depicted in FIGS. 1, 2 and 3, each of which can utilize the adjustable securing belts depicted, showing hook or loop material in the shoulder areas for attaching or accommodating the attaching of a shoulder pad type object and a partitioned pocket with removable/insertable protective pads to protect the upper back area.

Referring now to the drawings, the present invention comprises a multi-section, one-piece garment 10 for protecting against impact upon a human torso when worn by an athlete during sporting activities comprising a vest/jersey 13 sized and shaped to be worn on the torso of an athlete having an anterior portion 22, a posterior portion 24, a pair of lateral portions 26 and a shoulder portion 28 and including an offset opening 30 and an overlap 32 in the anterior portion 22 and a tapered design 34 in the inferior-most region of the posterior portion 24, as shown in FIGS. 1 and 4. Key features of the invention as shown in FIG. 1 include a pocket 42 with a removable/insertable protective pad 43 to protect the chest area in the anterior portion 22, belt-loop-type loops 52 in the shoulder area 28 for attaching or accommodating the attaching of shoulder pad type objects and short sleeves 62 attached to the shoulder area 28 with protective padding 65, 66 to protect the arm socket/shoulder joint and upper arm areas.

Figure 2:
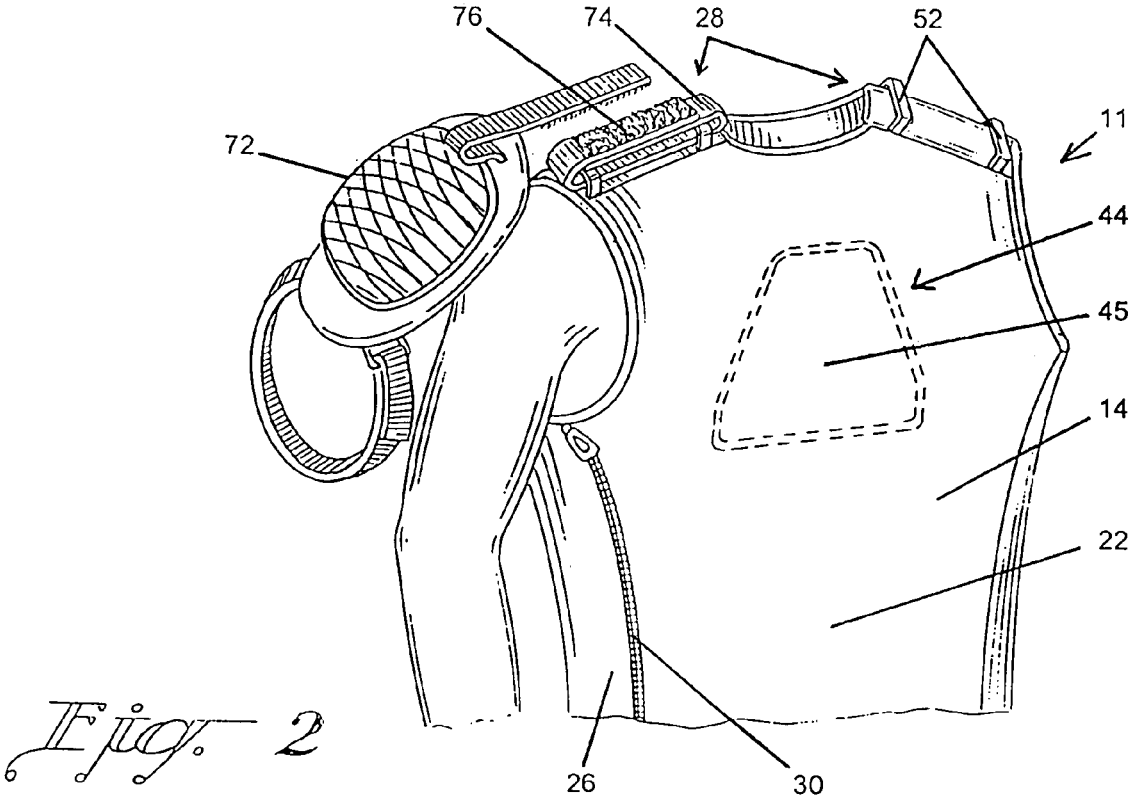
FIG. 2 is a front/side view of an alternative embodiment of the vest that has an offset opening offset more to the side than the offset opening in FIG. 1, and, as such, is donned/removed in an over-the-head, pull-over manner, a pocket with a removable/insertable protective pad to protect the chest area and belt-loop-type loops in the shoulder areas for attaching or accommodating the attaching of a shoulder pad type object. A shoulder pad type object is depicted to demonstrate one method by which a shoulder pad type object could be attached to the shoulder area: through the use of a separate strap with exposed hook or loop material that is looped through the belt-loop-type loops in the shoulder area and fastens to itself so as to leave the hook (or loop) material exposed for use in fastening to loop (or hook) material on the shoulder pad type object.

Another embodiment of the present invention comprises a multi-section, one-piece garment 11 for protecting against impact upon a human torso when worn by an athlete during sporting activities comprising a vest/jersey 14 donned/removed in a pull-over manner sized and shaped to be worn on the torso of an athlete having an anterior portion 22, a posterior portion 24, a pair of lateral portions 26 and a shoulder portion 28 and including an offset opening 30 at the juncture of the anterior portion 22 and right-hand-side lateral portion 26, as shown in FIGS. 2 and 4. Key features of the invention as shown in FIG. 2 include a pocket 44 with a removable/insertable protective pad 45 to protect the chest area in the anterior portion 22 and belt-loop-type loops 52 in the shoulder area 28 for attaching or accommodating the attaching of shoulder pad type objects.

A shoulder pad type object 72 is depicted to demonstrate one method by which a shoulder pad type object 72 could be attached to the shoulder area 28: through the use of a separate strap 74 with exposed hook or loop material 76 that is looped through the belt-loop-type loops in the shoulder area 52 and fastens to itself so as to leave the hook (or loop) material exposed for use in fastening to loop (or hook) material on the shoulder pad type object 72.

Figure 3:
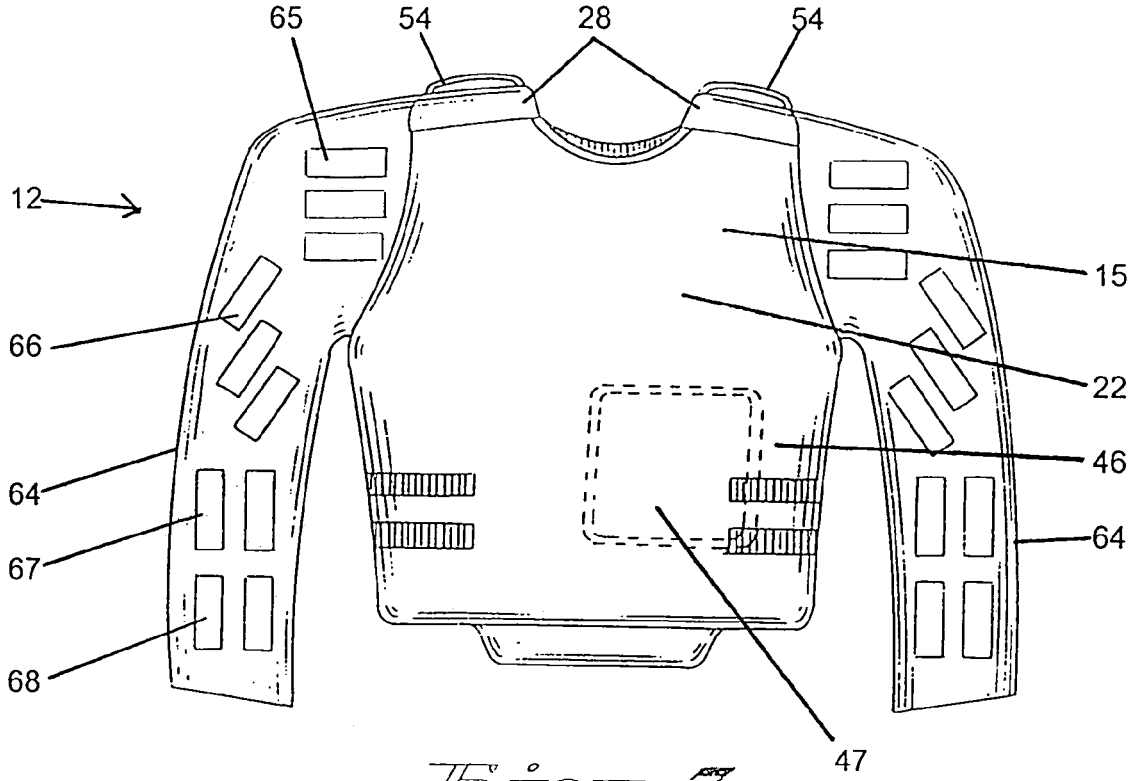
FIG. 3 is a front view of an alternative embodiment of the pullover version of the vest that has no offset opening, a pocket with a removable/insertable protective pad to protect the spleen area, epaulet-type loops or tunnels for attaching or accommodating the attaching of a shoulder pad type object and long sleeves with protective padding to protect the arm socket/shoulder joint, upper arm, the middle arm/elbow and lower arm areas.

Another embodiment of the present invention comprises a multi-section, one-piece garment 12 for protecting against impact upon a human torso when worn by an athlete during sporting activities comprising a vest/jersey 15 donned and removed in a pull-over manner sized and shaped to be worn on the torso of an athlete having an anterior portion 22, a posterior portion 24, a pair of lateral portions 26 and a shoulder portion 28 and including a tapered design 34 in the inferior-most region of the posterior portion 24 and adjustable securing belts 82, as shown in FIGS. 3 and 4. Key features of the invention as shown in FIG. 3 include a pocket 46 with a removable/insertable protective pad 47 to protect the spleen area in the anterior portion 22, epaulet-type loops or tunnels 54 in the shoulder area 28 for attaching or accommodating the attaching of shoulder pad type objects and long sleeves 64 attached to the shoulder area 28 with protective padding 65, 66, 67 and 68 to protect the arm socket/shoulder joint, upper arm, middle arm/elbow and lower arm areas. Key features of the invention as shown in FIG. 4 include hook (or loop) material 56 in the shoulder area 28 for attaching or accommodating the attaching of a shoulder pad type object and a partitioned pocket 48 with removable/insertable protective pads 49 in the posterior portion 24 to protect the upper back area.

What is claimed is:

1. A multi-section, one-piece garment for protecting against impact upon a human torso when worn by an athlete during sporting activities, the multi-section, one-piece garment comprising:

a vest/jersey sized and shaped to be worn on a torso of an athlete, the vest/jersey comprising an anterior portion, a posterior portion, a pair of lateral portions and a shoulder portion, the vest/jersey having a multi-layered padding in the anterior portion and the shoulder portion and/or the lateral portions and/or the posterior portion of the vest/jersey to protect the torso of the athlete, the multi-layered padding having three layers, wherein the first, or outer layer and the third, or inner layer of the multi-layered padding sandwich, or are joined at a seam to provide a shell for, the second, or middle layer, the second layer being formed from a padding material for protecting against impact to the torso, the posterior portion and/or the lateral portions and/or the shoulder portions of the vest/jersey being comprised of material that provides for the cooling of the underlying torso, the vest/jersey having an offset opening or offset openings, the offset opening or offset openings being located off set from the medial line of a human torso to protect the heart against impact, the vest/jersey having a fastening device or devices, the fastening device or devices being fastened to secure the vest/jersey about the torso.

2. The multi-section, one-piece garment of claim 1, wherein each shoulder portion comprises at least one fastening device or means therein for attaching or accommodating attachment of a shoulder pad type object.

3. The multi-section, one-piece garment of claim 1, wherein at least one protective pad can be attached via at least one fastening device to, or inserted into at least one pocket having at least one partition and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, the anterior portion and sized and shaped to provide protection from impact to the anterior portion, or a section or sections thereof, the protective pad or pads being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

4. The multi-section, one-piece garment of claim 1, wherein at least one protective pad can be attached via at least one fastening device to, or inserted into at least one pocket having at least one partition and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, the posterior portion and sized and shaped to provide protection from impact to the posterior portion, or a section or sections thereof, the protective pad or pads being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

5. The multi-section, one-piece garment of claim 1, wherein at least one protective pad can be attached via at least one fastening device to, or inserted into at least one pocket having at least one partition and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, at least one lateral portion and sized and shaped to provide protection from impact to the lateral portion, or a section or sections thereof, the protective pad or pads being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

6. The multi-section, one-piece garment of claim 1, wherein at least one protective pad can be attached to, or inserted into at least one pocket having at least one partition and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, at least one shoulder portion and sized and shaped to provide protection from impact to the shoulder portion, or a section or sections thereof, the protective pad or pads being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

7. The multi-section, one-piece garment of claim 1, wherein sleeves are attached to the respective shoulder portions.

8. The multi-section, one-piece garment of claim 7, wherein the sleeves are removable, each sleeve being fastened to the respective shoulder portion by at least one fastening device.

9. The multi-section, one-piece garment of claim 7, wherein the lower portion of each sleeve is removable, the lower portion of each sleeve being fastened to the upper portion by at least one fastening device.

10. The multi-section, one-piece garment of claim 7, wherein the sleeves incorporate protective padding to provide protection to at least one portion of the arm socket/shoulder joint area.

11. The multi-section, one-piece garment of claim 10, wherein at least one portion of the protective padding in the arm socket/shoulder joint area is removable.

12. The multi-section, one-piece garment of claim 7, wherein the sleeves incorporate protective padding to provide protection to at least one portion of the upper arm area.

13. The multi-section, one-piece garment of claim 12, wherein at least one portion of the protective padding in the upper arm area is removable.

14. The multi-section, one-piece garment of claim 7, wherein the sleeves incorporate protective padding to provide protection to at least one portion of the middle arm or elbow area.

15. The multi-section, one-piece garment of claim 13, wherein at least one portion of the protective padding in the middle arm or elbow area is removable.

16. The multi-section, one-piece garment of claim 7, wherein the sleeves incorporate protective padding to provide protection to at least one portion of the lower arm area.

17. The multi-section, one-piece garment of claim 16, wherein at least one portion of the protective padding in the lower arm area is removable.

18. A multi-section, one-piece garment for protecting against impact upon a human torso when worn by an athlete during sporting activities, the multi-section, one-piece garment comprising:

a vest/jersey sized and shaped to be worn on a torso of an athlete, the vest/jersey having a multi-layered padding to protect the torso of the athlete including a chest, an abdomen, a pair of lateral regions, a shoulder area and a back, the vest/jersey further comprising a shoulder portion, an anterior portion, a pair of lateral portions, a posterior portion and an offset opening or offset openings, the multi-layered padding having three layers, wherein the first, or outer layer and the third, or inner layer of the multi-layered padding sandwich, or are joined at a seam to provide a shell for, the second, or middle layer, the second layer being formed from a padding material for protecting against impact to the torso, the shoulder portion having a pair of oversized apertures located at the lateral most regions for receiving the arms, each oversized aperture being sized and shaped to permit full movement of the arm, the offset opening or offset openings being offset from the medial line of a human torso to protect the heart against impact;

the vest/jersey having a fastening device or devices, the fastening device or devices being fastened to secure the vest/jersey about the torso.

19. The multi-section, one-piece garment of claim 18, wherein each shoulder portion comprises at least one fastening device or means therein for attaching or accommodating attachment of a shoulder pad type object.

20. The multi-section, one-piece garment of claim 18, wherein at least one protective pad can be attached via at least one fastening device to, or inserted into at least one pocket having at least one partition and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, the anterior portion and sized and shaped to provide protection from impact to the anterior portion, or a section or sections thereof, the protective pad or pads being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

21. The multi-section, one-piece garment of claim 18, wherein at least one protective pad can be attached via at least one fastening device to, or inserted into at least one pocket having at least one partition and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, the posterior portion and sized and shaped to provide protection from impact to the posterior portion, or a section or sections thereof, the protective pad or pads being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

22. The multi-section, one-piece garment of claim 18, wherein at least one protective pad can be attached via at least one fastening device to, or inserted into at least one pocket having at least one partition and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, at least one lateral portion and sized and shaped to provide protection from impact to the lateral portion, or a section or sections thereof, the protective pad or pads being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

23. The multi-section, one-piece garment of claim 18, wherein at least one protective pad can be attached via at least one fastening device to, or inserted into at least one pocket having at least one partition and attached via at least one fastening device or fastening means to the interior and/or exterior surface of the first, or outer layer of the multi-layer padding, or a layer or layers thereof, and/or the interior and/or exterior surface of the second, or middle layer of the multi-layered padding, or a layer or layers thereof, and/or the interior and/or exterior surface of the third, or inner layer of the multi-layered padding, or a layer or layers thereof, or in the seam where the first, or outer layer and the third, or inner layer of the multi-layered padding are joined to provide a shell for the second or middle layer, at least one shoulder portion and sized and shaped to provide protection from impact to the shoulder portion, or a section or sections thereof, the protective pad or pads being removable and insertable by the wearer, with access to the interior of the shell provided via either the slot or opening that allows for the removal or insertion of the second, or middle layer of the multi-layer padding from the vest/jersey, or a separate slot or opening located on the interior or exterior surface of the shell, or in the seam where the first and third layers of the multi-layer padding are joined to form the shell, which may or may not be secured in a closed position by a fastening device or devices.

24. The multi-section, one-piece garment of claim 18, wherein sleeves are attached to the respective shoulder portions.

25. The multi-section, one-piece garment of claim 24, wherein the sleeves are removable, each sleeve being fastened to the respective shoulder portion by at least one fastening device.

26. The multi-section, one-piece garment of claim 24, wherein the lower portion of each sleeve is removable, the lower portion of each sleeve being fastened to the upper portion by at least one fastening device.

27. The multi-section, one-piece garment of claim 24, wherein the sleeves incorporate protective padding to provide protection to at least one portion of the arm socket/shoulder joint area.

28. The multi-section, one-piece garment of claim 27, wherein at least one portion of the protective padding in the arm socket/shoulder joint area is removable.

29. The multi-section, one-piece garment of claim 24, wherein the sleeves incorporate protective padding to provide protection to at least one portion of the upper arm area.

30. The multi-section, one-piece garment of claim 28, wherein at least one portion of the protective padding in the upper arm area is removable.

31. The multi-section, one-piece garment of claim 24, wherein the sleeves incorporate protective padding to provide protection to at least one portion of the middle arm or elbow area.

32. The multi-section, one-piece garment of claim 31, wherein at least one portion of the protective padding in the middle arm or elbow area is removable.

33. The multi-section, one-piece garment of claim 24, wherein the sleeves incorporate protective padding to provide protection to at least one portion of the lower arm area.

34. The multi-section, one-piece garment of claim 33, wherein at least one portion of the protective padding in the lower arm area is removable.

* * * * *